US006981778B2

(12) United States Patent
Dow et al.

(10) Patent No.: US 6,981,778 B2
(45) Date of Patent: Jan. 3, 2006

(54) PORTABLE LIGHT BOX

(75) Inventors: Donald D. Dow, Eden Prairie, MN (US); Gary Lee Ferrell, Brooklyn Park, MN (US)

(73) Assignee: Artograph, Inc., Plymouth, MN (US)

( * ) Notice: Subject to any disclaimer, the term of this patent is extended or adjusted under 35 U.S.C. 154(b) by 0 days.

(21) Appl. No.: 10/760,065

(22) Filed: Jan. 16, 2004

(65) Prior Publication Data

US 2005/0157505 A1 Jul. 21, 2005

(51) Int. Cl.
*G09F 33/00* (2006.01)

(52) U.S. Cl. ..... 362/97; 362/33; 362/155; 362/156; 362/374

(58) Field of Classification Search ..... 362/33, 362/97–98, 154–156, 374; 108/23
See application file for complete search history.

(56) References Cited

U.S. PATENT DOCUMENTS 1,320,537 A * 11/1919 Dimond ..... 362/99
1,374,363 A * 4/1921 Davis ..... 33/444
2,127,601 A * 8/1938 Jaffe ..... 355/82
D117,096 S * 10/1939 Good et al. ..... D19/52
2,196,863 A * 4/1940 Hassenfeld ..... 312/231
2,257,005 A * 9/1941 Grosse ..... 108/23
2,328,471 A * 8/1943 Leffel ..... 108/6
2,517,914 A * 8/1950 Nowaczek ..... 362/155
2,541,890 A * 2/1951 Schaperkotter et al. ..... 312/222
2,596,043 A * 5/1952 Piker ..... 220/4.01
2,638,397 A * 5/1953 Wykoff ..... 312/231
3,019,331 A * 1/1962 Geist ..... 362/97
3,104,492 A * 9/1963 Banks ..... 108/23
3,356,839 A * 12/1967 Mineo et al. ..... 362/31
3,964,193 A * 6/1976 Degenhardt et al. ..... 40/367
3,967,869 A * 7/1976 Jackson ..... 312/270.1
4,184,194 A * 1/1980 Shofu ..... 362/97
4,312,507 A * 1/1982 Smith et al. ..... 273/237
4,335,421 A * 6/1982 Modia et al. ..... 362/223
4,406,368 A * 9/1983 Hermes ..... 206/371
4,564,886 A * 1/1986 Morcheles ..... 362/97
4,592,285 A * 6/1986 Egli ..... 108/9
4,621,308 A * 11/1986 Holmberg et al. ..... 362/154
4,654,762 A * 3/1987 Laverick ..... 362/97
4,700,634 A * 10/1987 Mills et al. ..... 108/43
4,751,620 A * 6/1988 Wright et al. ..... 362/99

(Continued)

FOREIGN PATENT DOCUMENTS

WO WO 95/30980 11/1995

*Primary Examiner*—Stephen Husar
*Assistant Examiner*—Jason Han
(74) *Attorney, Agent, or Firm*—Larkin Hoffman Daly & Lindgren Ltd.; Thomas J. Oppold, Esq.

(57) ABSTRACT

A portable light box having a reflector assembly, a carrying case and divider. The reflector assembly includes a base having an upper peripheral edge defining an interior volume, a light source disposed within the interior volume and a cover plate disposed over the interior volume. The carrying case includes a top portion and a bottom portion, movable between a first closed position and a second open position with the reflector assembly received in the bottom portion of the carrying case. The divider is removably received within the top portion of the carrying case and is disposed so as to provide a wall within the carrying case to separate the tools from the reflector assembly to prevent damage to the cover plate while the carrying case is in the first closed position.

20 Claims, 5 Drawing Sheets

U.S. PATENT DOCUMENTS 4,794,492 A * 12/1988 Vinther ..... 362/31
4,892,334 A * 1/1990 Sinclair ..... 281/45
4,908,742 A * 3/1990 Kersey ..... 362/156
4,938,355 A * 7/1990 Rocco ..... 206/372
4,969,068 A * 11/1990 Williams ..... 362/99
5,099,581 A * 3/1992 Svehaug ..... 33/430
5,207,495 A * 5/1993 Ahlstone ..... 362/33
5,217,293 A * 6/1993 Kobzeff ..... 362/97
5,284,445 A * 2/1994 Dietterich et al. ..... 434/419
5,287,254 A * 2/1994 Solman ..... 362/98
5,295,742 A * 3/1994 Knutson ..... 312/244
5,333,408 A * 8/1994 Simmons ..... 43/54.1
5,348,144 A * 9/1994 Maier ..... 206/1.7
5,432,687 A * 7/1995 Lane ..... 362/99
5,459,648 A * 10/1995 Courtney ..... 362/154
5,460,102 A * 10/1995 Pasmanick ..... 108/43
5,497,706 A * 3/1996 Yong ..... 108/23
5,680,914 A * 10/1997 Reiser ..... 190/11
5,680,932 A * 10/1997 Dickinson et al. ..... 206/372
5,680,973 A * 10/1997 Vulpitta et al. ..... 224/153
6,098,793 A * 8/2000 Jaksha ..... 206/214
6,267,484 B1 * 7/2001 Baker et al. ..... 362/156
6,315,120 B1 * 11/2001 Tally et al. ..... 206/373
6,659,620 B2 * 12/2003 Goto ..... 362/127

* cited by examiner

PORTABLE LIGHT BOX

BACKGROUND OF THE INVENTION

Light boxes (also sometimes referred to as light tables) are well known and often used by graphic artists, illustrators and drafters, as well as by hobbyists and even children for tracing patterns or designs. Generally, light boxes comprise a housing or frame that contains a fluorescent or incandescent lamp for illuminating or back-lighting a work surface upon which is supported both the source pattern or design desired to be traced and the overlying medium onto which the source pattern or design is to be traced.

Various tools and other items are used with light boxes, including different papers, pens, pencils, erasers, paints, inks, markers, crayons, brushes, stencils, embossing tools, tape, rulers, straight edges, etc. For portable light boxes, particularly those used by hobbyists and children, it is generally desirable to have the tools conveniently stored with the light box. U.S. Pat. No. 4,654,762 issued to Laverick recognizes the advantages of incorporating a tool tray into the light box, but provides no cover or other means for securing the tools to prevent them from spilling and being lost when the light box is being moved from place to place. As such, the Laverick light box is not readily portable since it must remain substantially horizontal and upright at all times to avoid spilling of the tools from the tool tray.

Furthermore, light boxes have heretofore failed to provide a carrying case so as to allow easy portability of the light box while at the same time protecting the work surface so as to avoid marring, soiling or otherwise damaging the work surface while the light box is being moved between work areas or is otherwise being transported or shipped or while in storage.

Accordingly, there remains a need for a light box that is readily portable, that includes a means for holding and organizing tools, both while in use and during transportation between work areas, and which ensures that the illuminating work surface is protected from damage by the tools during transportation.

SUMMARY OF THE INVENTION

The present invention is a portable light box that comprises a reflector assembly, a carrying case and divider. The reflector assembly includes a base having an upper peripheral edge defining an interior volume. Disposed within the interior volume of the base is a light source. In a preferred embodiment, the light source includes an electric lamp, such as a fluorescent or incandescent lamp, electrically connected to an AC power source and/or an alternative internal DC battery source. A cover plate is disposed over the interior volume. In a preferred embodiment the upper peripheral edge of the base supports the cover plate at an inclined slope so as to provide a more convenient working surface.

The carrying case includes a top portion and a bottom portion. The reflector assembly is preferably removably received within the bottom portion. The top and bottom portions are movable between a first closed position and a second open position. In a preferred embodiment, the top portion is removably hingedly secured to the bottom portion of the carrying case.

The divider is preferably removably received within the top portion of the carrying case and is disposed so as to provide a wall within the carrying case to separate the tools from the reflector assembly to prevent damage to the cover plate while the carrying case is in the first closed position.

The divider preferably includes a plurality of recesses for receiving various tools, supplies and other items therein.

To the accomplishment of the above objectives, features and advantages, the present invention may be embodied in the forms illustrated in the accompanying drawings, attention being called to the fact, however, that the drawings are illustrative only, and that changes may be made in the specific form illustrated and described without materially departing from the teachings herein.

DETAILED DESCRIPTION OF THE INVENTION

Figure 1:
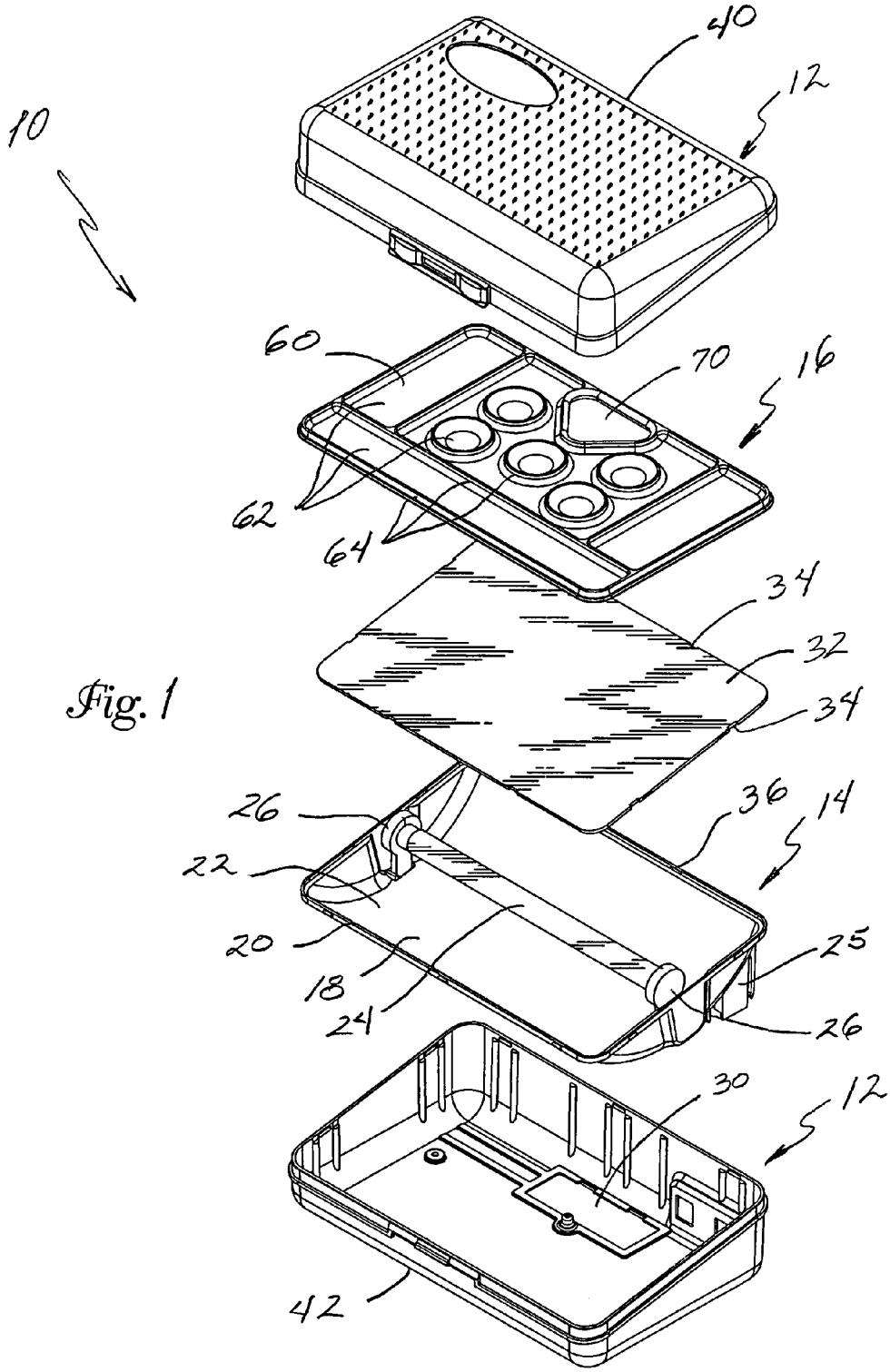
FIG. 1 is an exploded perspective view of a preferred embodiment of the light box of the present invention.

Drawing FIGS. 1–7 illustrate a preferred embodiment of the portable light box 10 of the present invention wherein like reference numerals designate corresponding parts throughout the several views of the drawings. An exploded perspective view of a preferred embodiment of the portable light box 10 of the present invention is illustrated in FIG. 1 showing the individual components comprising the preferred light box, including the preferred carrying case 12, the preferred reflector assembly 14, and the preferred divider 16.

The reflector assembly 14 includes a base 18 having an upper peripheral edge 20 defining an interior volume 22. The interior volume 22 of the base 18 preferably has a smooth white glossy finish to reflect the light form the light source 24 (discussed below). The base 18 is preferably formed using an injection molding process using high impact polystyrene (HIPS), although other fabrication methods and materials may be equally suitable.

Figure 3:
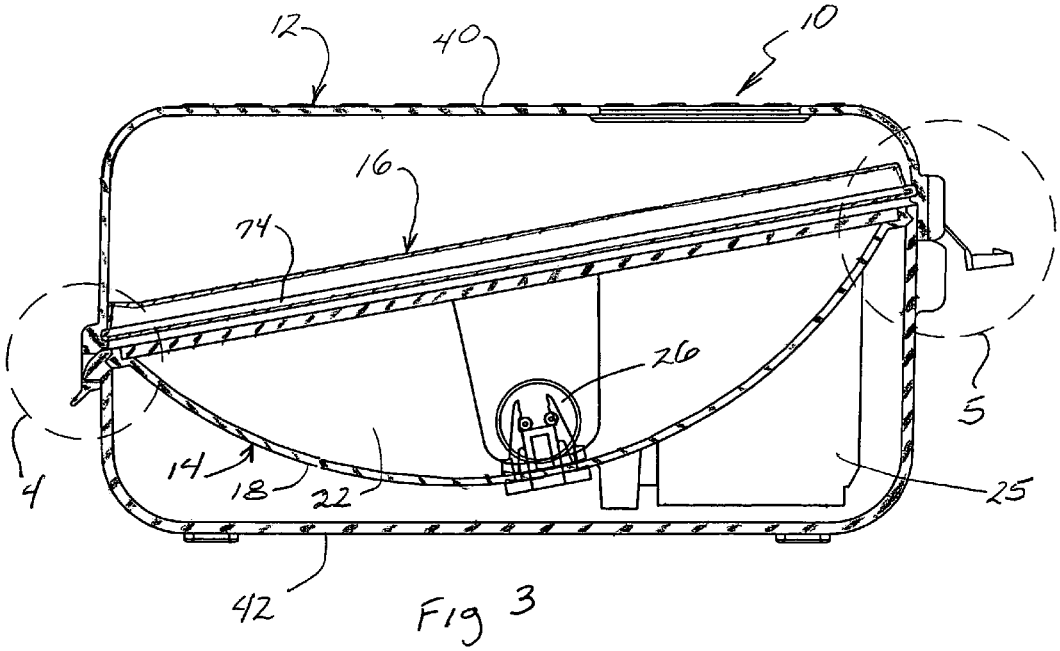
FIG. 3 is a cross-sectional view of the light box of FIG. 1 as viewed along lines 3—3 of FIG. 2.
Figure 8:
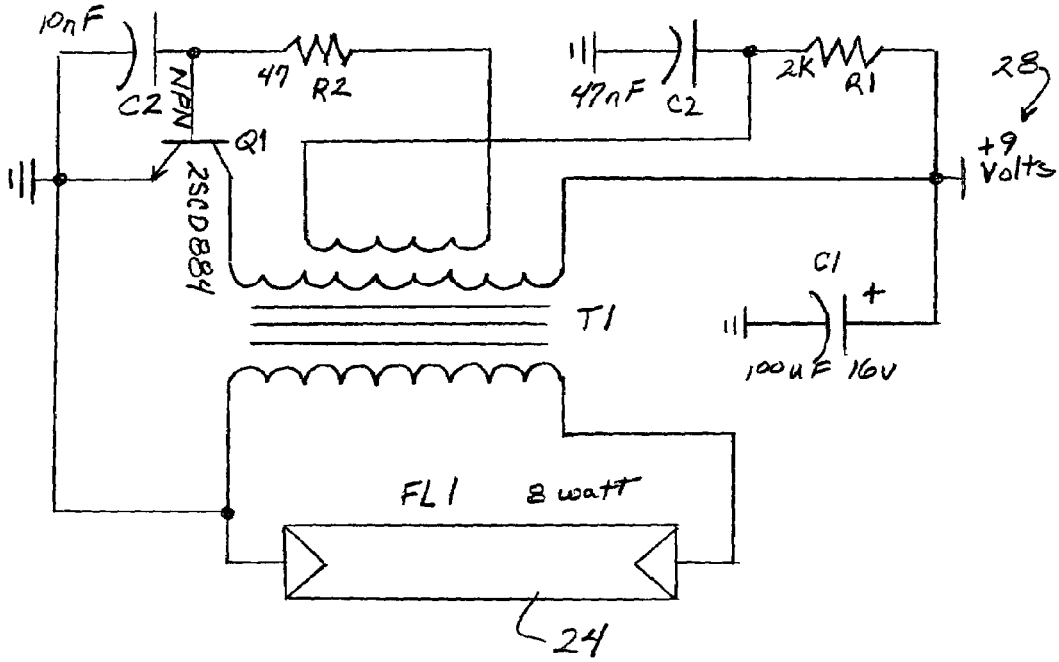
FIG. 8 is an electrical schematic showing the preferred electrical circuit for the preferred light box of the present invention.

Disposed within the interior volume 22 is a light source 24, such as a fluorescent bulb or lamp removably receivable within sockets 26 (best viewed in FIG. 3). It should be appreciated that although the preferred light source 24 is a fluorescent lamp, the light box 10 may also utilize one or more incandescent lamps, or any other suitable electric lamp as a light source 24. The light source 24 is, of course, powered by an electrical power source 28 (FIG. 8). The electrical power source 28 may be provided by either internal DC batteries or by external AC power. In the preferred embodiment, external AC power is supplied by a power cord 29 (FIG. 6) for connecting to a typical AC outlet. The preferred embodiment also provides for internal nine volt DC battery power. Storage for the batteries is provided in cavity 25 (FIG. 3) in the reflector assembly base 18, accessible through a door 30 (FIG. 1) in the bottom portion 42 of the carrying case 12. An on/off switch 31 (FIG. 6) is preferably provided to control power to the light source 24. Those skilled in the art will readily appreciate the electrical circuitry required to provide the preferred dual power source for powering the light source 24. An electrical schematic of the preferred electrical circuit is shown in FIG. 8. The components comprising the electrical circuitry are preferably disposed adjacent the batteries in the cavity 25 (FIG. 3) located in the reflector assembly base 18 disposed in the bottom portion 42 of the carrying case 12.

A cover plate 32 is disposed over the interior volume 22 of the base and is preferably supported around its exterior periphery by the upper peripheral edge 20 of the reflector assembly base 18. In the preferred embodiment, both the upper peripheral edge 20 and the cover plate 32 supported thereby are sloped at an incline from front to rear so as to provide a convenient working surface. The cover plate 32 is preferably translucent so as to more evenly diffuse the light from the light source 24. Additionally, the cover plate 32 is preferably rigid, smooth and sufficiently hard so as to provide a working surface that will support the force exerted by the user when using the light box in the manner previously described and which is not easily marred or scratched molded from HIPS. Other suitable material such as glass, plexiglass, or any other fairly hard, rigid and smooth material may also be used. Furthermore, although the preferred cover plate is translucent for purposes of better light diffusion, opaque or transparent materials may be equally suitable for the cover plate, depending on the needs of the project or preferences of the user. The outer periphery of the cover plate 32 preferably includes a plurality of indentations 34 which are matingly received by tabs 36 around the upper periphery 20 of the base which removably secures the cover plate 32 in place over the interior volume 22 of the base 18.

The carrying case 12 is preferably fabricated from a lightweight, durable material such as polypropylene using an injection molding process. It should be appreciated that other fabrication methods and materials, including other polymers, metal, wood, etc., may be used depending on manufacturing requirements or limitations, or depending on qualities and features of the carrying case desired by a user. The preferred carrying case 12 includes a top portion 40 and a bottom portion 42. The reflector assembly 14 is preferably removably secured within the bottom portion 42 of the carrying case, such as by screws, snap fittings, or other means recognized by those skilled in the art.

Figure 2:
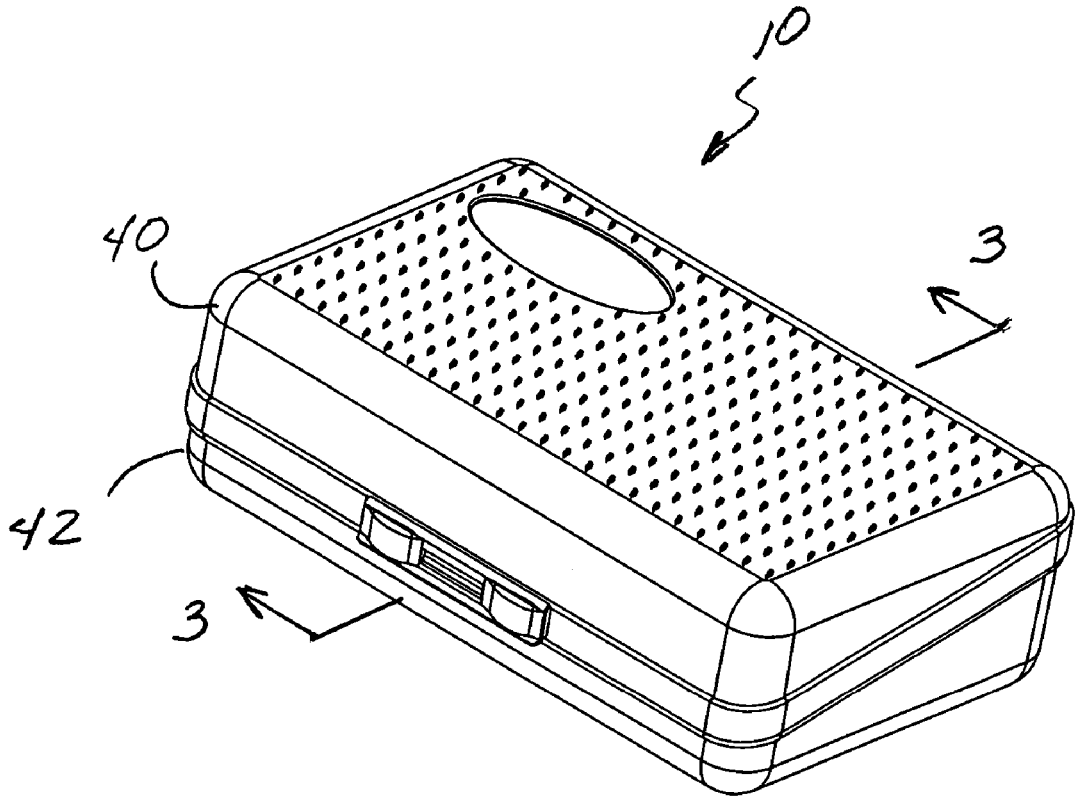
FIG. 2 is a perspective view of a preferred embodiment of the light box of FIG. 1 with the carrying case in the first closed position.
Figure 6:
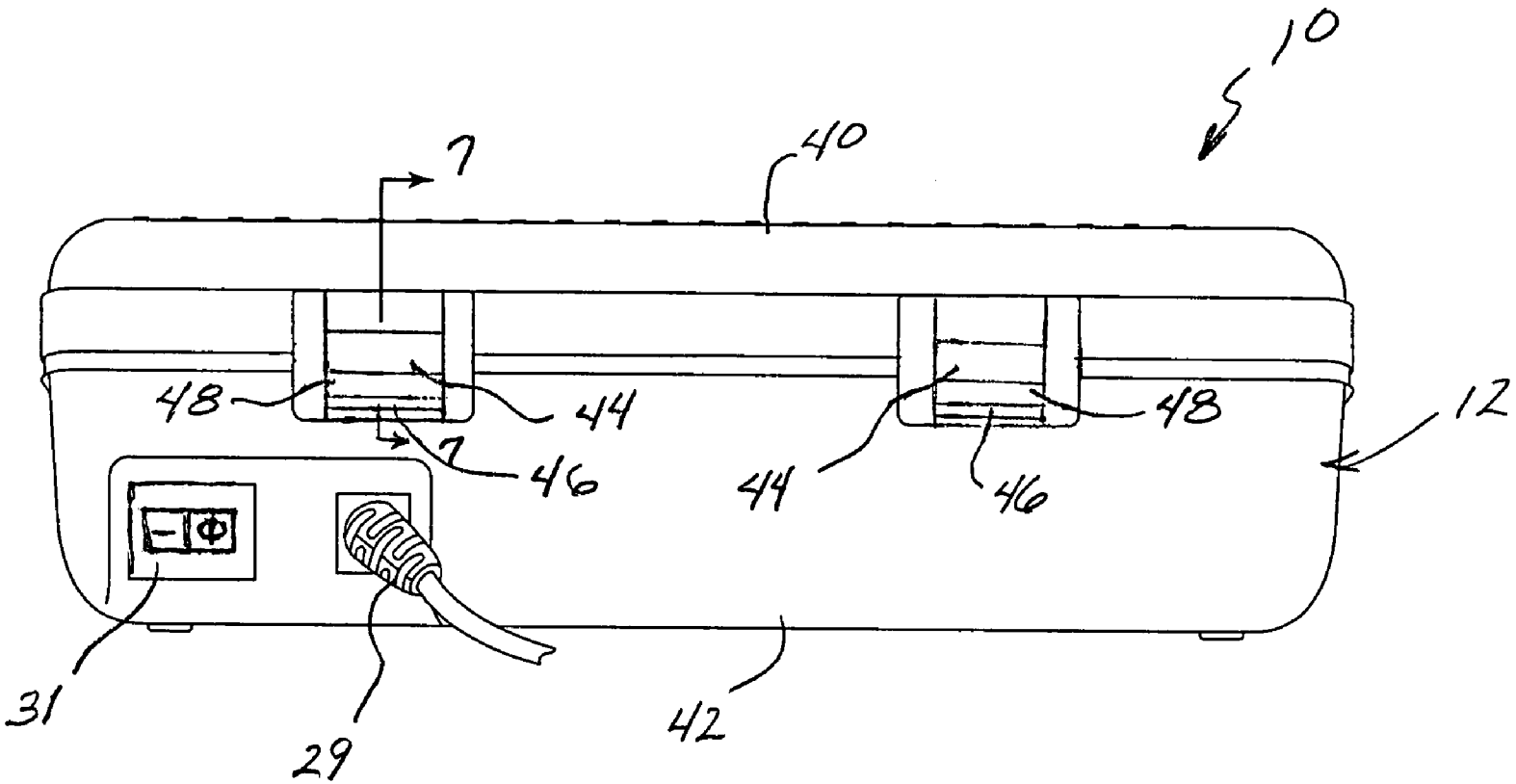
FIG. 6 is a rear elevation view of the preferred embodiment of the light box of the present invention with the carrying case in the first closed position.
Figure 7:
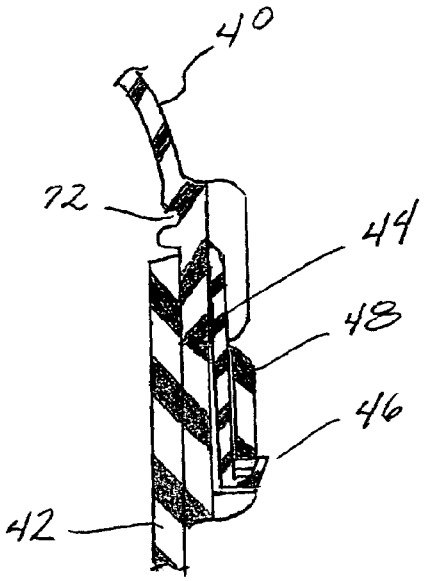
FIG. 7 is a cross sectional view of the light box of FIG. 6 as viewed along lines 7—7.

The top and bottom portions 40, 42 are preferably movable with respect to each other between a first closed position as illustrated in FIGS. 2 and 3 and a second open position as illustrated in FIGS. 1 and 7. As best illustrated in FIGS. 3, 6 and 7, the top portion 40 is preferably removably, hingedly attached to the bottom portion 42 at the rear of the carrying case. In the preferred embodiment, the top portion 40 includes two pliable male hinge straps 44, each having a protruding lip 46 that is removably received by a corresponding female hinge portion 48 matingly disposed on the bottom portion 42 of the carrying case 12.

Figure 4:
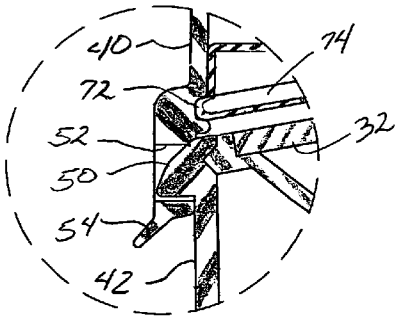
FIG. 4 is a detailed view of the portion of the light box identified in FIG. 3 by reference numeral 4.

Referring now to FIGS. 3 and 4, at the front of the carrying case 12, the top portion 40 is preferably removably secured to the bottom portion 42 by the cooperation of an elongated protruding lip 50 in the bottom portion 42 that is received into a mating elongated opening 52 in the top portion 40. In the preferred embodiment, to open the carrying case 12, an upward and outward force is exerted on the handle 54 which causes the elongated protruding lip 50 to be released from the elongated opening 52.

The divider 16, is preferably fabricated from HIPS using an injection molding process. It should be appreciated, however, that the divider 16 may be formed using any other fabrication method and material, including other polymers, metal, wood, etc., depending on manufacturing requirements or limitations, or depending on qualities and features of the divider desired by a user. The preferred divider 16 is preferably light weight yet sufficiently rigid to support tools, supplies and other items (collectively hereinafter "tools") while being held by the hand of a user as hereinafter described. The divider 16 is preferably similar to a palette, with its upper surface 60 having a plurality of recesses 62 defined by rims 64. The bottom surface 66 of the divider palette 16 is preferably a solid flat surface. The size and locations of the recesses 62 may very depending on the tools to be received therein. It should be appreciated, therefore, that the illustration of the divider palette 16 shown in FIG. 2 is provided merely as an example for illustration purposes only. The divider 16 preferably includes a triangular opening 70 to allow a user to grasp and hold the divider 16 during use in a variety of manners depending on the preferences of the user, the size of the user's hand, and the orientation desired for the divider during use.

Figure 5:
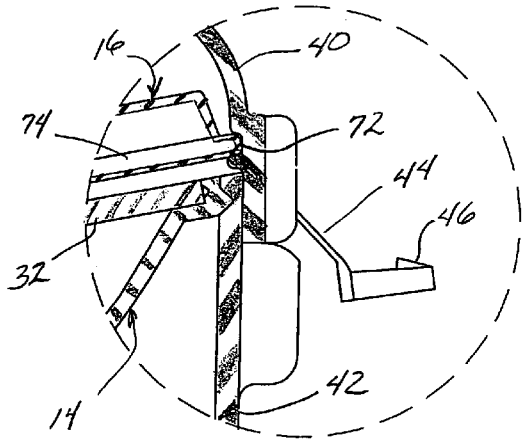
FIG. 5 is a detailed view of the portion of the light box identified in FIG. 3 by reference numeral 5.

Referring now to FIGS. 3, 4 and 5, the divider 16 is preferably removably received and supported within the top portion 40 of the carrying case 12 by a divider support 72. In the preferred embodiment as shown in FIGS. 4 and 5, the divider support 72 includes a plurality of spaced recesses which form shoulders or shelves upon which the peripheral rim 74 of the divider 16 rests. Alternatively, the divider support 72 may include a peripheral groove or the like within which, or on which, the peripheral rim of the divider 16 is supported. In any event, with the divider 16 so disposed, a dividing wall is created in the top portion of the carrying case 12 as best illustrated in FIG. 3. This dividing wall secures the tools within the top portion 40 of the carrying case 12 and away from the reflector assembly cover plate 32 thereby preventing scratching or soiling of the cover plate 32 by the tools during movement of the light box in the closed carrying case position.

In addition, rather than removing and holding the divider 16 during use as previously described, it may be desirable to place the top portion 40 of the carrying case 12 face down and to snap the peripheral rim 74 of the divider 16 into the divider support 72 of the inverted top portion of the carrying case, thereby providing an inclined tool tray. Alternatively, the divider 16 can simply be removed from the top portion 40 of the carrying case 12 and placed on a table or other surface near the light box 10.

Although only certain exemplary embodiments of the invention have been described in detail above, those skilled in the art will readily appreciate that many modifications are possible without materially departing from the novel teachings and advantages of this invention. Accordingly, all such modifications are intended to be included within the scope of the appended claims.

What is claimed is:

1. A portable light box, comprising:

a. a reflector assembly, said reflector assembly including, i. a base having an upper peripheral edge defining an interior volume;

ii. a light source disposed within said interior volume; and iii. a cover plate disposed over said interior volume;

b. a carrying case having a top portion and a bottom portion, each defining an interior volume, said top and bottom portions of said carrying case movable between a first closed position and a second open position, said reflector assembly received within said interior volume of said bottom portion of said carrying case; and c. a divider removably disposable within said interior volume of said top portion of said carrying case.

2. The portable light box of claim 1 wherein said top portion of said carrying case is removably secured to said bottom portion of said carrying case.

3. The portable light box of claim 1 wherein said cover plate is translucent.

4. The portable light box of claim 1 wherein said divider comprises a palette having a plurality of recesses formed in an upper surface thereof for receiving items therein.

5. The portable light box of claim 4 wherein said palette includes an opening for grasping by a hand of a user to hold said palette during use.

6. The portable light box of claim 5 wherein said opening in said palette is triangular.

7. The portable light box of claim 1 wherein said interior volume of said top portion of said carrying case includes a divider support to removably receive and support said divider within said interior volume of said top portion of said carrying case.

8. The portable light box of claim 1 wherein said light source includes at least one electric lamp electrically connected to an electric power source.

9. The portable light box of claim 8 wherein said electric power source includes a DC battery source.

10. The portable light box of claim 8 wherein said electric power source includes an AC power source.

11. The portable light box of claim 8 wherein said electric power source includes a DC battery source and an AC power source.

12. In combination a portable light box and tools for use therewith, comprising:

a. a reflector assembly, said reflector assembly including, i. a base having an upper peripheral edge defining an interior volume;

ii. a light source disposed within said interior volume; and iii. a cover plate disposed over said interior volume;

b. a carrying case having a top portion and a bottom portion, each defining an interior volume, said top and bottom portions of said carrying case movable between a first closed position and a second open position, said reflector assembly received within said interior volume of said bottom portion of said carrying case; and c. a divider removably disposable within said carrying case above said cover plate and within said interior volume of said top portion of said carrying case when said carrying case is in said first closed position, said divider having recesses for receiving the tools, whereby when said carrying case is in said first closed position, the tools are restrained between the divider and an inner surface of said closed top portion of said carrying case.

13. The combination of claim 12 wherein said top portion of said carrying case is removably secured to said bottom portion of said carrying case.

14. The combination of claim 12 wherein said cover plate is translucent.

15. The combination of claim 15 wherein said divider is a palette having an opening for grasping by a hand of a user to hold said palette during use.

16. The combination of claim 12 wherein said interior volume of said top portion of said carrying case includes a divider support to removably receive and support said divider within said interior volume of said top portion of said carrying case.

17. The combination of claim 12 wherein said light source includes at least one electric lamp electrically connected to an electric power source.

18. The combination of claim 17 wherein said electric power source includes a DC battery source.

19. The combination of claim 17 wherein said electric power source includes an AC power source.

20. The combination of claim 17 wherein said electric power source includes a DC battery source and an AC power source.

* * * * *